US011353042B1

(12) United States Patent
Lee et al.

(10) Patent No.: US 11,353,042 B1
(45) Date of Patent: Jun. 7, 2022

(54) ELECTRIC WATER PUMP

(71) Applicant: COAVIS, Sejong-si (KR)

(72) Inventors: Hyun Tae Lee, Sejong-si (KR); Wan Sung Pae, Sejong-si (KR); Woo Keun Lee, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 17/122,207

(22) Filed: Dec. 15, 2020

(30) Foreign Application Priority Data

Nov. 23, 2020 (KR) ..... 10-2020-0157351

(51) Int. Cl.

| | |
|---|---|
| ***F04D 29/42*** | (2006.01) |
| ***F04D 29/043*** | (2006.01) |
| ***F04D 29/22*** | (2006.01) |
| ***F04D 13/06*** | (2006.01) |
| ***F04D 29/62*** | (2006.01) |
| ***F04D 29/041*** | (2006.01) |
| ***F04D 29/046*** | (2006.01) |
| ***F04D 29/047*** | (2006.01) |
| ***F04D 13/02*** | (2006.01) |
| ***F04D 29/20*** | (2006.01) |
| ***F04D 29/057*** | (2006.01) |

(52) U.S. Cl.

CPC ..... *F04D 29/426* (2013.01); *F04D 13/026* (2013.01); *F04D 13/06* (2013.01); *F04D 13/0606* (2013.01); *F04D 13/0633* (2013.01); *F04D 29/043* (2013.01); *F04D 29/046* (2013.01); *F04D 29/047* (2013.01); *F04D 29/0413* (2013.01); *F04D 29/0473* (2013.01); *F04D 29/057* (2013.01); *F04D 29/20* (2013.01); *F04D 29/22* (2013.01); *F04D 29/628* (2013.01)

(58) Field of Classification Search

CPC ..... F04D 13/06; F04D 13/026; F04D 29/426; F04D 29/0413; F04D 13/0633; F04D 29/043; F04D 29/22; F04D 13/0606; F04D 29/046; F04D 29/047; F04D 29/628; F04D 29/0473; F04D 29/20; F04D 29/057

See application file for complete search history.

(56) References Cited

U.S. PATENT DOCUMENTS

| | | | | |
|---|---|---|---|---|
| 5,184,945 | A * | 2/1993 | Chi-Wei | F04D 29/0413 384/321 |
| 9,188,128 | B2 | 11/2015 | Lee et al. | |
| 10,030,661 | B2 * | 7/2018 | Torii | H02K 1/2706 |
| 2001/0043865 | A1 * | 11/2001 | Rennett | F04D 29/047 417/44.1 |
| 2014/0271279 | A1 * | 9/2014 | Kuba | F04D 13/064 417/420 |
| 2018/0128279 | A1 * | 5/2018 | Ogawa | F04D 29/0413 |

FOREIGN PATENT DOCUMENTS

KR 20130059782 A 6/2013

* cited by examiner

*Primary Examiner* — Peter J Bertheaud
(74) *Attorney, Agent, or Firm* — The Webb Law Firm

(57) ABSTRACT

Provided is an electric water pump in which a portion of a fluid discharged from the vicinity of an outer peripheral edge of an impeller flows between the impeller and a lower casing, flows between a rotor and the lower casing, flows between a shaft and the rotor along a channel formed inside the rotor, and then flows to an inlet side of the impeller such that the fluid circulates outside and inside the rotor, and thus, foreign matters contained in the fluid do not accumulate in an accommodation space between the rotor and the lower casing, and thus, efficiency and durability of a motor can be improved.

8 Claims, 6 Drawing Sheets

ELECTRIC WATER PUMP

CROSS-REFERENCE TO RELATED APPLICATIONS

This application claims priority to Korean Patent Application No. 10-2020-0157351 filed Nov. 23, 2020, the disclosure of which is hereby incorporated by reference in its entirety.

BACKGROUND OF THE INVENTION

Field of the Invention

The following disclosure relates to an electric water pump which rotates the pump by driving a motor so as to feed a fluid.

Description of Related Art

A water pump is a device for circulating a coolant to an engine or heater for cooling the engine or heating a room. The water pumps are largely divided into a mechanical water pump and an electric water pump, and the electric water pump which is driven by rotation of a motor controlled by a control device is mainly used.

In general, the electric water pump includes a housing, a stator, and a rotor constituting a motor unit, and an impeller and an impeller casing constituting a pump unit. In addition, the stator is provided inside the housing and fixed to the housing, the rotor is disposed to be spaced apart from the inside of the stator, the impeller is coupled to a rotating shaft of the rotor, and the impeller casing is coupled to the housing so as to cover the impeller. Moreover, the rotor is formed integrally with the rotating shaft and the impeller, the rotor is accommodated in an accommodation space formed to be recessed in the impeller casing in which the impeller is accommodated, so that the rotor is rotatably coupled to the impeller casing and the housing, and the rotor is in contact with the fluid and is formed in a sealed form to prevent the fluid from entering the stator.

However, in the electric water pump, a portion of the fluid discharged from the vicinity of an outer peripheral edge of the impeller may flow in between the impellers and between the rotor and the impeller casing. Accordingly, foreign matters contained in the fluid accumulate in the accommodation space between the rotor and the impeller casing, and thus, there is a problem in that efficiency and durability of the motor are reduced.

RELATED ART DOCUMENT

Patent Document

Korean Patent Laid-Open Publication No. 10-2013-0059782 (Jun. 7, 2013)

SUMMARY OF THE INVENTION

An embodiment of the present invention is directed to providing an electric water pump having a structure capable of circulating a fluid so that foreign matters do not accumulate in an accommodation space between a rotor receiver of a lower casing in which a rotor is accommodated and the rotor.

In one general aspect, an electric water pump includes: a lower casing configured to include a rotor receiver protruding downward and having a rotor accommodating space formed to be recessed downward from an upper surface; a shaft configured to be disposed inside the rotor receiver of the lower casing and to have a lower end portion fixed to a bottom of the rotor receiver to extend upward; an impeller configured to be disposed above the lower casing and to have a hollow penetrating vertically at a center portion thereof; a rotor configured to be integrally formed with the impeller so as to be fitted into the shaft and inserted into the rotor accommodation space of the lower casing to be rotatable together with the impeller; a motor housing configured to be coupled to a lower side of the lower casing; and a stator configured to be provided inside the motor housing to be fitted into an outer side of the rotor receiver of the lower casing, in which the rotor includes a through-hole penetrating both upper and lower surfaces, receiving grooves are respectively formed to be recessed on both upper and lower sides of the through-hole, a bushing is inserted into each of the receiving grooves to be fixed thereto, and the bushing is fitted into the shaft to be rotatably coupled to the shaft, and the rotor includes a communication channel configured to be connected to the receiving grooves and the through-hole and penetrate both the upper and lower surfaces of the rotor so that an upper end of the communication channel is connected to the hollow of the impeller.

The shaft may include a fixed shaft formed to extend vertically and a fixed plate formed integrally with the fixed shaft to be perpendicular to a lower end of the fixed shaft, and the fixed plate may be fixed to the bottom of the rotor receiver.

The shaft may be integrally formed with the rotor receiver by insert injection.

In the shaft, a lower end portion of the fixed shaft and the fixed plate may be embedded in the bottom to be fixed thereto.

The communication channel may be formed to be recessed radially outward from the receiving grooves and an inner peripheral surface of the through-hole.

A lower end of the bushing disposed below the rotor may be formed to protrude downward than a lower end of the rotor.

The electric water pump may further include a spacer configured to be disposed between the bushing disposed below the rotor and the bottom of the rotor receiver and to be fitted into the shaft.

The electric water pump may further include a snap ring configured to be disposed above the bushing disposed above the rotor and to be fitted into the shaft to be fixed to the shaft.

The electric water pump may further include: an upper casing configured to be coupled to an upper side of the lower casing, to be coupled to the lower casing to form an impeller accommodation space for accommodating the impeller inside the upper casing, and to communicate with the impeller accommodation space so as to have an inlet into which a fluid flows and an outlet through which the fluid is discharged.

In the fluid which flows into the inlet when the impeller rotates, a portion of the fluid may flow downward between the impeller, the rotor, and the lower casing on a fluid discharge side of the impeller, flow upward along a communication channel formed in the rotor, and then flow to a fluid inlet side of the impeller.

DETAILED DESCRIPTION OF MAIN ELEMENTS

Figure 1:
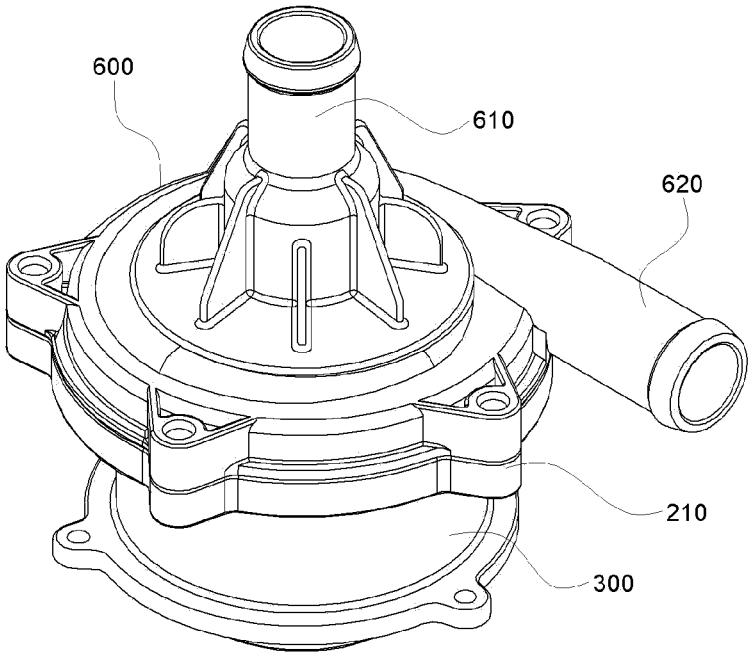
FIGS. 1 to 3 are an assembled perspective view, an exploded perspective view, and a front cross-sectional view illustrating an electric water pump according to an embodiment of the present invention.

100: stator
210: lower casing
211: lower receiving groove
212: lower channel groove
220: rotor receiver
221: bottom
230: shaft
231: fixed shaft
232: fixed plate
300: motor housing
400: rotor
410: through-hole
420: receiving groove
430: bushing
440: bushing
450: spacer
460: communication channel
470: snap ring
500: impeller
510: upper plate
520: lower plate
530: blade
600: upper casing
610: inlet
620: outlet
630: upper receiving groove
632: upper channel groove

DESCRIPTION OF THE INVENTION

Hereinafter, an electric water pump of the present invention will be described in detail with reference to the accompanying drawings.

Figure 2:
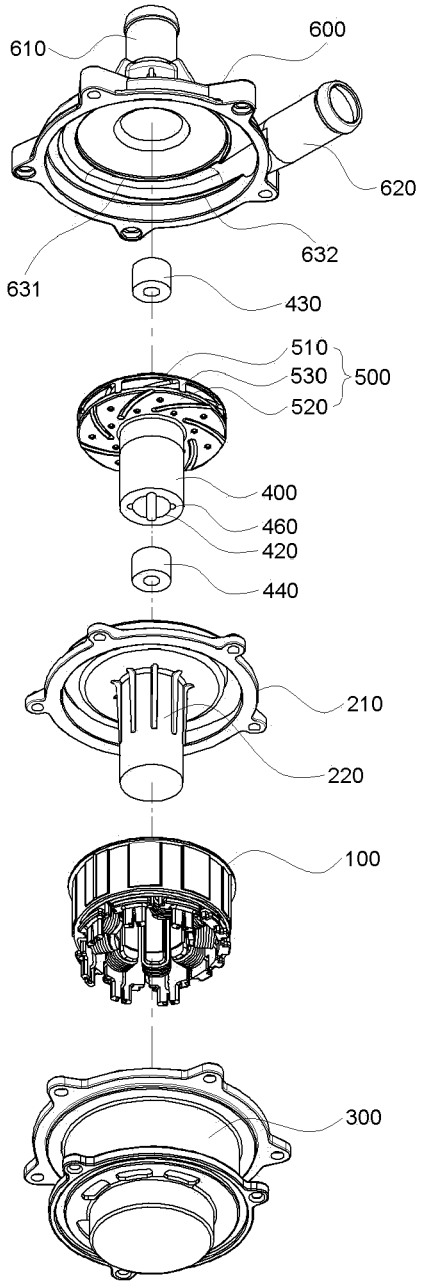
Figure 3:
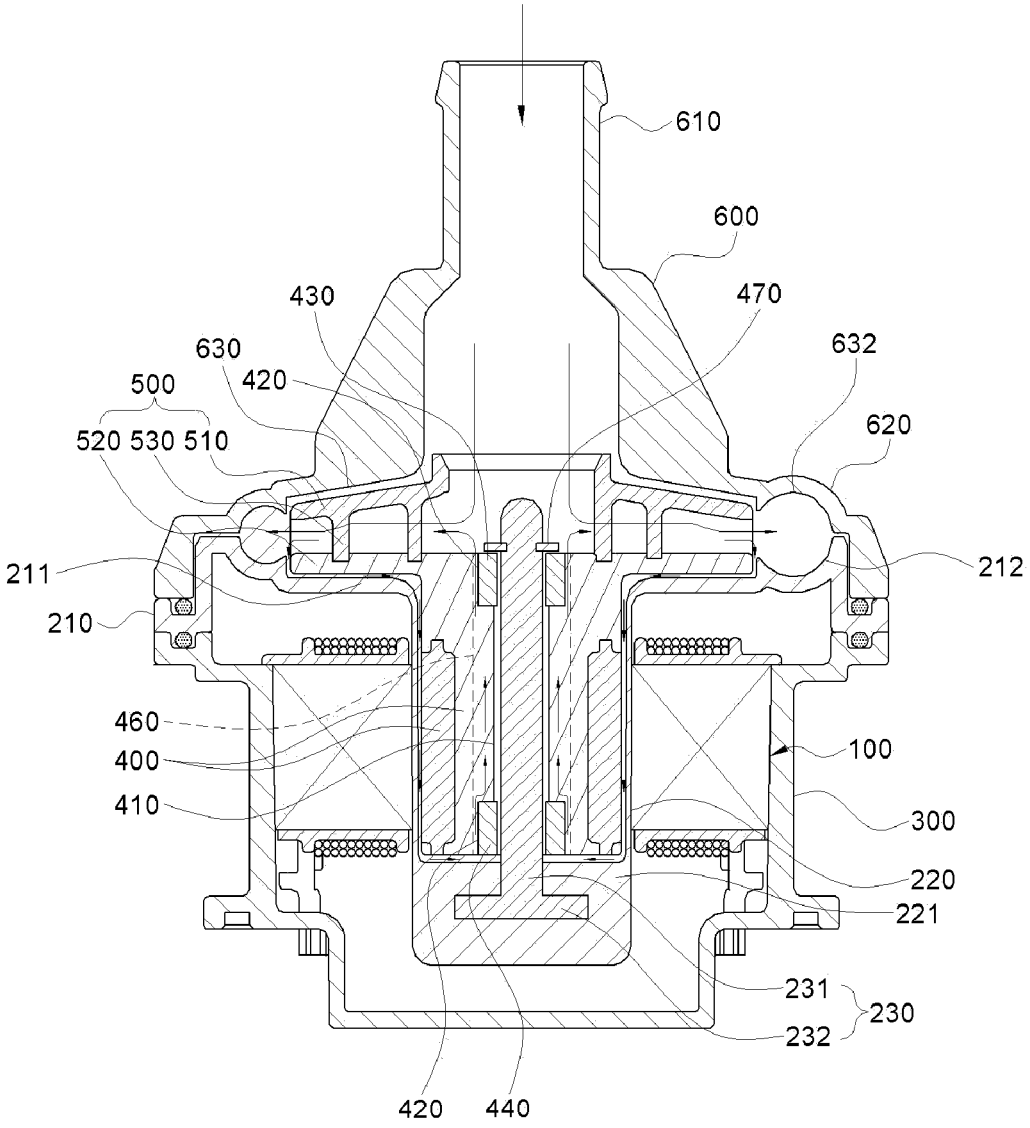
Figure 4:
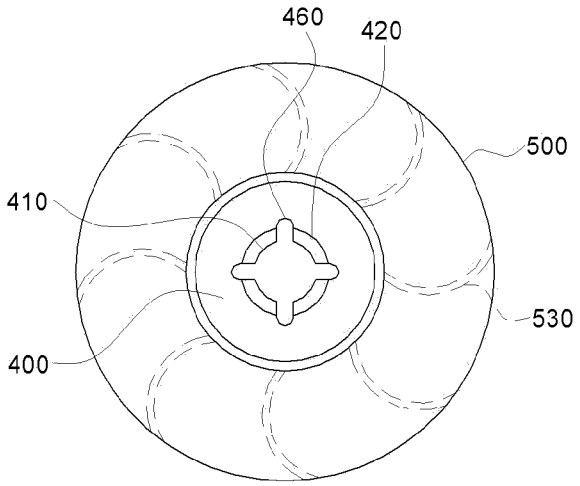
FIG. 4 is a plan view when an impeller and a rotor in the electric water pump according to the embodiment of the present invention are viewed above.

FIGS. 1 to 3 are an assembled perspective view, an exploded perspective view, and a front cross-sectional view illustrating an electric water pump according to an embodiment of the present invention, and FIG. 4 is a plan view when an impeller and a rotor in the electric water pump according to the embodiment of the present invention are viewed above.

As illustrated in the drawings, the electric water pump according to the embodiment of the present invention may be configured to include a lower casing 210, a shaft 230, an impeller 500, a rotor 400, a motor housing 300, and a stator 100, and may be configured to further include an upper casing 600.

The lower casing 210 may include a lower receiving groove 211 which is formed to be recessed downward from an upper surface to accommodate a portion of the impeller 500, and a lower channel groove 212 which is formed to be recessed radially outside the lower receiving groove 211 so that a fluid discharged from the impeller 500 flows thereto. Moreover, the lower casing 210 may include a rotor receiver 220 which is formed to protrude downward from a central portion of a portion in which the lower receiving groove 211 is formed and has a recessed container shape.

The shaft 230 is disposed inside the rotor receiver 220, and thus, a lower end portion of the shaft 230 may be coupled and fixed to a bottom 221 of the rotor receiver 220. The shaft 230 may be configured to include a fixed shaft 231 and a fixed plate 232, the fixed shaft 231 may be formed to extend vertically, and the fixed plate 232 may be formed to be coupled to be perpendicular to a lower end of the fixed shaft 231. In addition, in the shaft 230, the fixed shaft 231 and the fixed plate 232 may be integrally formed with each other, and the shaft 230 may be integrally formed with the rotor receiver 220 of the lower casing 210. That is, the shaft 230 may be formed integrally with the rotor receiver 220 by insert injection, and for example, the shaft 230 may be formed by the insert injection so that the lower end portion of the fixed shaft 231 and the fixed plate 232 are embedded in the bottom 221 of the rotor receiver 220. Accordingly, only the lower end portion of the shaft 230 is fixed to the rotor receiver 220 and the upper end portion thereof may be a free end.

The impeller 500 rotates to pressurize the fluid. The impeller 500 may include an upper plate 510, a lower plate 520, and a blade 530, and a plurality of the blades 530 may be formed to be spaced circumferentially from each other between the upper plate 510 and the lower plate 520 disposed spaced apart vertically from each other. In addition, the impeller 500 may include a hollow which is formed to penetrate the impeller 500 vertically at a center portion, the fluid flows in through the hollow, and the fluid may be discharged from the vicinity of an outer peripheral edge of the impeller 500. That is, the impeller may be a centrifugal impeller. In addition, for example, in the impeller 500, the lower plate 520 may be integrally formed with a core of the rotor 400, and the upper plate 510 and the blades 530 may be integrally formed with each other so that the blades 530 are coupled to the lower plate 520. Moreover, the impeller may be formed in various shapes which can be rotated integrally with the rotor.

The rotor 400 may be disposed below the impeller 500 to be integrally formed with the impeller 500, the rotor 400 may be inserted into a rotor accommodating space inside the rotor receiver 220, and the rotor 400 may be fitted to the shaft 230 so that the rotor 400 and the impeller 500 are rotated about the shaft 230 together. In more detail, the rotor 400 may have a through-hole 410 penetrating both upper and lower surfaces, and receiving grooves 420 may be concavely formed respectively on both upper and lower sides of the through-hole 410. In addition, bushings 430 and 440 for reducing a friction with the shaft 230 may be respectively inserted into the receiving grooves 420 so that the bushings 430 and 440 may be fixed to the rotor 400, and the bushings 430 and 440 are fitted into the shaft 230 so that the rotor 400 can rotate smoothly. In this case, in a state in which the rotor 400 and the impeller 500 are integrally formed with each other, the bushing 430 disposed on the upper side may be inserted into the upper receiving groove 420 of the rotor 400 through the hollow formed at the center portion of the impeller 500 above the impeller 500 and may be coupled to the upper receiving groove 420, and the bushing 440 disposed on the lower side may be inserted into the lower receiving groove 420 below the rotor 400 and coupled to the lower receiving groove 420. Moreover, the rotor 400 may have a communication channel 460 penetrating both upper and lower surfaces, and the communication channel 460 may be formed to be recessed radially outward from the receiving grooves 420 and an inner peripheral surface of the through-hole 410, and an upper end of the communication channel 460 may be connected to the hollow of the impeller 500. In addition, a snap ring 470 may be fitted into an upper end portion of the shaft 230 above the bushing 430 disposed on the upper side of the rotor 400 and coupled to the upper end portion. Accordingly, the snap ring 470 can prevent the rotor 400 and the impeller 500 from being separated upward.

The motor housing 300 may be formed in a recessed container made of a metal material, and may be formed to have an empty inside and an open upper side. In addition, the motor housing 300 may be coupled to a lower side of the lower casing 210.

The stator 100 may be provided inside the motor housing 300 and may be coupled to the motor housing 300 in a state where an outer peripheral surface of a core 110 of the stator 100 is in contact with an inner peripheral surface of the motor housing 300. In addition, the stator 100 may be formed to have a central portion which is open up and down, and thus, the stator 100 may be fitted into the outside of the rotor receiver 220 and coupled thereto. In addition, holes penetrating vertically are formed at a lower side of the motor housing 300, the three-phase terminals of the stator 100 can be drawn out of the motor housing 300 through the holes, and a gap between the terminal 150 and the hole may be sealed with a sealing member or the like.

The upper casing 600 is coupled to an upper side of the lower casing 210, the upper casing 600 and the lower casing 210 are coupled to each other, and thus, the impeller accommodation space in which the impeller 500 can be accommodated is formed inside the upper casing 600. Moreover, an upper receiving groove 630 formed to be recessed upward to accommodate a portion of the impeller 500 is formed on a lower surface of the upper casing 600, and thus, the impeller accommodation space is formed by the lower receiving groove 211 and the upper receiving groove 630. In addition, an upper channel groove 632 into which the fluid discharged from the impeller 500 flows is formed at a position corresponding to the lower channel groove 212 of the lower casing 210 on a lower surface of the upper casing 600. A central portion of the upper casing 600 may be formed to be open up and down, the upper receiving groove 630 and the inlet 610 may communicate with each other, and an outlet 602 may be formed to be connected to the upper channel groove 632 and the lower channel groove 212. In addition, the inside of the impeller 500 communicates with the inlet 610 of the upper casing 600. An outer peripheral edge of the impeller 500 is disposed close to the lower channel groove 212 and the upper channel groove 632. Accordingly, the fluid discharged from the impeller 500 may flow along the discharge channel formed in the channel grooves, and thereafter, may be discharged to the outlet 620 of the upper casing 600. That is, the fluid flowing into the inlet 610 of the upper casing 600 may flow into the hollow which is the central portion of the impeller 500, may be boosted by a centrifugal force caused by the rotation of the impeller 500, and may flow along the discharge channels and be discharged to the outside through the outlet 620.

Here, the impeller 500 is provided in the impeller accommodation space formed by the coupling of the lower casing 210 and the upper casing 600, and a gap exists so that the impeller 500 provided to be rotatable can slightly move up and down in the impeller accommodation space. In addition, since the rotor 400 is rotatably provided inside the rotor receiver 220, a gap exists between an outer peripheral surface of the rotor 400 and an inner peripheral surface of the rotor receiver 220. Similarly, a gap exists between a lower surface of the rotor 400 and an upper surface of the bottom 221 of the rotor receiver 220.

Thus, in the fluid which flows into the inlet 610 when the impeller 500 rotates, a portion of the fluid flows to the gap between the lower surface of the impeller 500 and the upper surface of the lower casing 210 near the outer peripheral edge of the impeller 500 which is the fluid discharge side of the impeller 500. Thereafter, the fluid flows downward between the outer peripheral surface of the rotor 400 and the inner peripheral surface of the rotor receiver 220, flows between the lower surface of the rotor 400 and the upper surface of the bottom 221 of the rotor receiver 220, flows upward along the communication channel 460 formed in the rotor 400, and then flows to the inlet of the impeller 500. Moreover, the fluid is circulated by repeating this process. In addition, there is a fine gap between the rotating rotor 400 and the fixed shaft 230, and there is also a fine gap between the bushings 430 and 440 rotated together with the rotor 400 and the shaft 230. Accordingly, a portion of the fluid flowing between the lower surface of the rotor 400 and the upper surface of the bottom 221 of the rotor receiver 220 may flow between the lower bushing 440 and the shaft 230, flow between the through-hole 410 of the rotor 400 and the shaft 230, flow between the lower bushing 440 and the shaft 230, and then flow to the inlet of the impeller 500.

Accordingly, in the electric water pump of the present invention, a portion of the fluid discharged from the vicinity of the outer peripheral edge of the impeller flows and the fluid circulates outside and inside the rotor. Accordingly, foreign matters contained in the fluid do not accumulate in the space between the rotor and the rotor receiver, and thus, efficiency and durability of the motor can be improved. In addition, since a structure is simple, manufacturing is easy and a manufacturing cost can be reduced.

Figure 5:
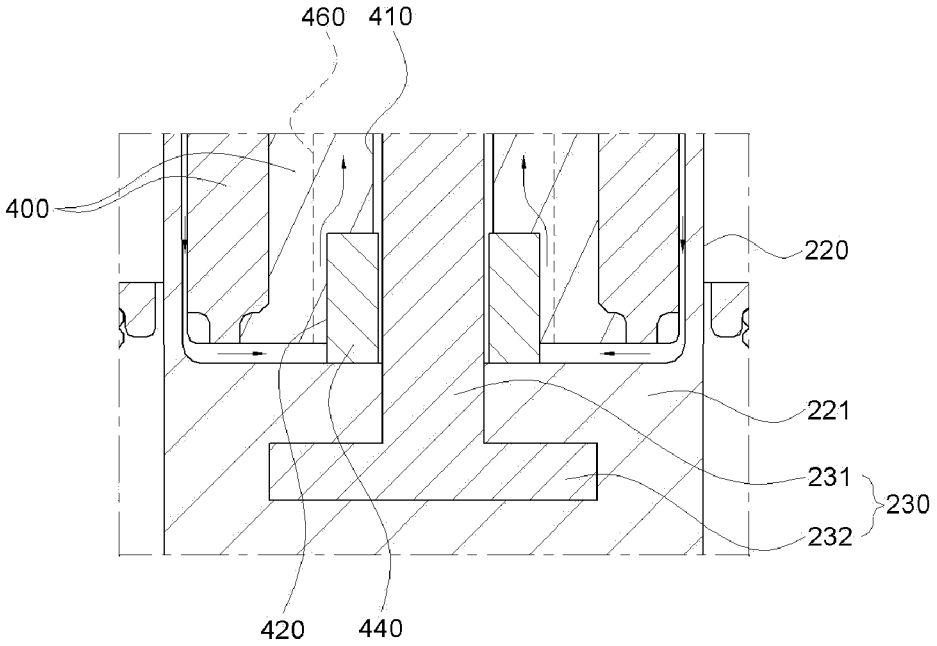
FIG. 5 is a cross-sectional view illustrating a modified embodiment of a bushing disposed below the rotor in the electric water pump according to the embodiment of the present invention.

FIG. 5 is a cross-sectional view illustrating a modified embodiment of the bushing disposed below the rotor in the electric water pump according to the embodiment of the present invention.

As illustrated in FIG. 5, in the electric water pump of the present invention, a lower end of the bushing 440 disposed below the rotor 400 may be formed to protrude downward than the lower surface of the rotor 400. Accordingly, it is easy to secure a space in which fluid can flow smoothly between the lower surface of the rotor 400 and the upper surface of the bottom 221 of the rotor receiver 220, and the fluid can easily flow to the communication channel 460 formed in the rotor 400.

Figure 6:
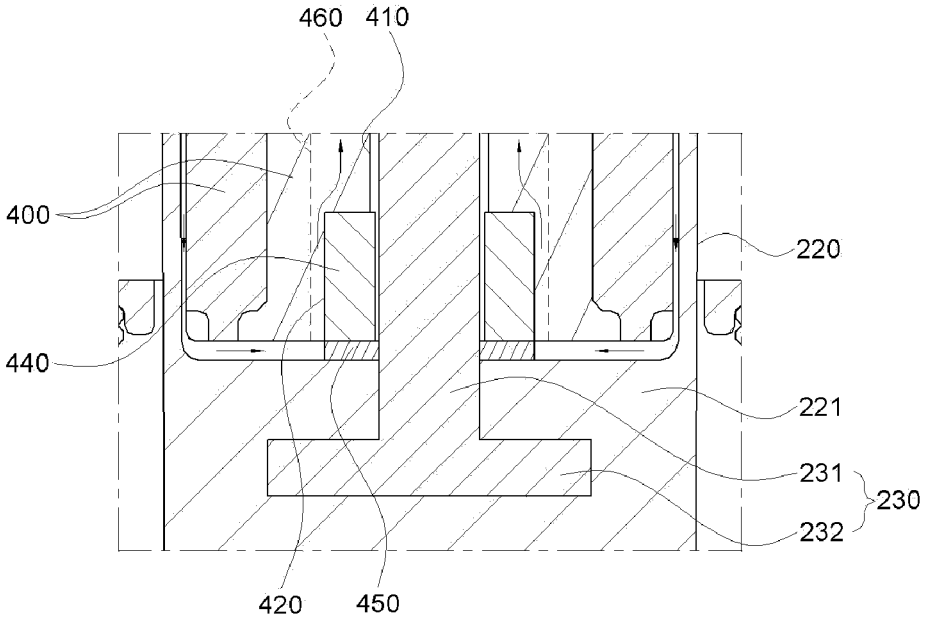
FIG. 6 is a cross-sectional view illustrating an embodiment in which a spacer is disposed between the bushing disposed below the rotor and a bottom of the rotor receiver in the electric water pump according to the embodiment of the present invention.

FIG. 6 is a cross-sectional view illustrating an embodiment in which a spacer is disposed between the bushing disposed below the rotor and the bottom of the rotor receiver in the electric water pump according to the embodiment of the present invention.

As illustrated in FIG. 6, a spacer 450 may be provided between the bushing 440 disposed below the rotor 400 and the bottom 221 of the rotor receiver 220, the spacer 450 may have a hole vertically penetrating a central portion of the spacer 450, and the spacer 450 may be coupled to shaft 230 in a state of being fitted into the shaft 230. Moreover, the spacer 450 may be formed in various forms and may be coupled in various ways, and may be coupled to the bottom 221 of the rotor receiver 220. Accordingly, it is easy to secure the space in which fluid can flow smoothly between the lower surface of the rotor 400 and the upper surface of the bottom 221 of the rotor receiver 220, and the fluid can easily flow to the communication channel 460 formed in the rotor 400.

According to the electric water pump of the present invention, a portion of a fluid discharged from the vicinity of an outer peripheral edge of the impeller flow, and thus, the fluid circulates outside and inside the rotor. Accordingly, foreign matters contained in the fluid do not accumulate in an accommodation space between the rotor and the impeller casing, and thus, efficiency and durability of a motor can be improved.

The present invention is not limited to the above-described embodiment, and a scope of application thereof is various. Moreover, it goes without saying that various modifications can be implemented by anyone of ordinary skill in the field to which the present invention pertains without departing from the gist of the present invention claimed in claims.

What is claimed is:

1. An electric water pump comprising:

a lower casing configured to include a rotor receiver protruding downward and having a rotor accommodating space formed to be recessed from an upper surface to a lower surface;

a shaft configured to be disposed inside the rotor receiver of the lower casing and to have a lower end portion fixed to a bottom of the rotor receiver to extend upward;

an impeller configured to be disposed above the lower casing and to have a hollow penetrating vertically at a center portion thereof;

a rotor configured to be integrally formed with the impeller so as to be fitted onto the shaft and inserted into the rotor accommodation space of the lower casing to be rotatable together with the impeller;

a motor housing configured to be coupled to a lower side of the lower casing; and a stator configured to be provided inside the motor housing to be fitted into an outer side of the rotor receiver of the lower casing, wherein the rotor includes a through-hole penetrating both upper and lower surfaces of the rotor, receiving grooves are respectively formed to be recessed on both upper and lower sides of the through-hole, a bushing is inserted into each of the receiving grooves to be fixed thereto, and the bushing is fitted onto the shaft to be rotatably coupled to the shaft, and the rotor includes a communication channel configured to be connected to the receiving grooves and the through-hole and penetrate both the upper and lower surfaces of the rotor so that an upper end of the communication channel is connected to the hollow of the impeller, wherein the shaft includes a fixed shaft formed to extend vertically and a fixed plate formed integrally with the fixed shaft to be perpendicular to a lower end of the fixed shaft, and the fixed plate is fixed to the bottom of the rotor receiver, wherein the shaft is integrally formed with the rotor receiver by insert injection, and wherein in the shaft, a lower end portion of the fixed shaft and the fixed plate are embedded in the bottom to be fixed thereto.

2. The electric water pump of claim 1, wherein the communication channel is formed to be recessed radially outward from the receiving grooves and an inner peripheral surface of the through-hole.

3. The electric water pump of claim 1, wherein a lower end of the bushing disposed below the rotor is formed to protrude downward than a lower surface of the rotor.

4. The electric water pump of claim 1, further comprising:

a spacer configured to be disposed between the bushing disposed below the rotor and the bottom of the rotor receiver and to be fitted onto the shaft.

5. The electric water pump of claim 1, further comprising:

a snap ring configured to be disposed above the bushing disposed above the rotor and to be fitted onto the shaft to be fixed to the shaft.

6. The electric water pump of claim 1, further comprising:

an upper casing configured to be coupled to an upper side of the lower casing, to be coupled to the lower casing to form an impeller accommodation space for accommodating the impeller inside the upper casing, and to communicate with the impeller accommodation space so as to have an inlet into which a fluid flows and an outlet through which the fluid is discharged.

7. The electric water pump of claim 6, wherein in the fluid which flows into the inlet when the impeller rotates, a portion of the fluid flows downward between the impeller, the rotor, and the lower casing on a fluid discharge side of the impeller, flows upward along the communication channel formed in the rotor, and then flows to a fluid inlet side of the impeller.

8. An electric water pump comprising:

a lower casing configured to include a rotor receiver protruding downward and having a rotor accommodating space formed to be recessed from an upper surface to a lower surface;

a shaft configured to be disposed inside the rotor receiver of the lower casing and to have a lower end portion fixed to a bottom of the rotor receiver to extend upward;

an impeller configured to be disposed above the lower casing and to have a hollow penetrating vertically at a center portion thereof;

a rotor configured to be integrally formed with the impeller so as to be fitted onto the shaft and inserted into the rotor accommodation space of the lower casing to be rotatable together with the impeller;

a motor housing configured to be coupled to a lower side of the lower casing; and a stator configured to be provided inside the motor housing to be fitted into an outer side of the rotor receiver of the lower casing, wherein the rotor includes a through-hole penetrating both upper and lower surfaces of the rotor, receiving grooves are respectively formed to be recessed on both upper and lower sides of the through-hole, a bushing is inserted into each of the receiving grooves to be fixed thereto, and the bushing is fitted onto the shaft to be rotatably coupled to the shaft, and the rotor includes a communication channel configured to be connected to the receiving grooves and the through-hole and penetrate both the upper and lower surfaces of the rotor so that an upper end of the communication channel is connected to the hollow of the impeller, wherein the communication channel is formed to be recessed radially outward from the receiving grooves and an inner peripheral surface of the through-hole.

* * * * *